US006488058B1

(12) United States Patent
Dyer et al.

(10) Patent No.: US 6,488,058 B1
(45) Date of Patent: Dec. 3, 2002

(54) GRAVITY FEED FLUID DISPENSING VALVE

(75) Inventors: John J. Dyer, Shoreview, MN (US); Corry P. Gunderson, Elk River, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/356,934

(22) Filed: Jul. 19, 1999

Related U.S. Application Data

(62) Division of application No. 08/946,759, filed on Oct. 8, 1997.

(51) Int. Cl.[7] ..... B65B 1/06

(52) U.S. Cl. ..... 141/346; 141/349; 141/351; 215/309; 220/253; 222/129.1; 222/153.14; 222/185.1; 222/325; 222/484; 222/548

(58) Field of Search ..... 141/2, 9, 18, 100, 141/105–107, 346, 348–355; 222/129.1, 145.5, 153.14, 185.1, 325, 484, 548; 220/253; 215/309, 310

(56) References Cited

U.S. PATENT DOCUMENTS 76,483 A 4/1868 Marcy
147,272 A 2/1874 Kittoe (List continued on next page.)

FOREIGN PATENT DOCUMENTS

CH 365660 12/1962
DE 102353 8/1898

(List continued on next page.)

OTHER PUBLICATIONS

"Twist 'N Fill ™ II Valve with Lock/Key Face" by Duncan Toll, including photographs, 4 page document (Date Unknown).
Twist'n Fill II Confidential Feature Development Outline #3, by Duncan Toll, 2 page document (Date Unknown).

(List continued on next page.)

*Primary Examiner*—David J. Walczak
*Assistant Examiner*—Kathleen J. Prunner

(57) ABSTRACT

A dispensing valve cap mountable to a bottle is provided with a first valve part having a tubular portion having an air inlet and a fluid outlet spaced apart along a longitudinal axis of the tubular portion to form a constant head valve for dispensing fluid from the bottle. A second valve part of the valve rotatably mounted to the first valve part includes a tubular portion for simultaneously closing both the air inlet and the fluid outlet of the first valve part when fluid dispensing is not desired. The second valve part further includes an air inlet, and a fluid outlet alignable with the air inlet and the fluid outlet of the tubular portion when fluid dispensing is desired. The dispensing valve cap controls fluid flow from the bottle. The bottle with the valve cap is useable with a dispenser assembly for mixing a concentrated fluid from the bottle with a dilutant. A tamper resistant lock prevents undesired rotation of the second valve part relative to the first valve part. The tamper resistant lock is deactivated upon insertion of the valve cap into the dispenser assembly. An orifice insert member with a predetermined fluid control aperture is positioned in the fluid outlet path to control fluid flow rate through the valve cap.

8 Claims, 13 Drawing Sheets

U.S. PATENT DOCUMENTS

| | | | | | |
|---|---|---|---|---|---|
| 196,437 | A | | 10/1877 | Downes | |
| 232,362 | A | | 9/1880 | Newton | |
| 251,923 | A | | 1/1882 | Newton | |
| 273,831 | A | | 3/1883 | Ely | |
| 500,260 | A | | 6/1893 | Carter | |
| 539,460 | A | | 5/1895 | Webster | |
| 585,327 | A | | 6/1897 | Guttenberg | |
| 654,016 | A | | 7/1900 | Miller | |
| 694,477 | A | | 3/1902 | Howland | |
| 705,160 | A | | 7/1902 | Swanson | |
| 815,158 | A | | 3/1906 | Graham et al. | |
| 857,056 | A | | 6/1907 | Harmon et al. | |
| 1,026,145 | A | | 5/1912 | Blackman et al. | |
| 1,054,146 | A | | 2/1913 | Smirle | |
| 1,221,350 | A | | 4/1917 | Miller | |
| 1,265,381 | A | | 5/1918 | Ramey | |
| 1,278,764 | A | | 9/1918 | Seiler | |
| 1,307,828 | A | | 6/1919 | Miller | |
| 1,310,405 | A | | 7/1919 | Deppermann | |
| 1,368,703 | A | | 2/1921 | Czerny | |
| 1,519,347 | A | | 12/1924 | Anderson | |
| 1,581,072 | A | * | 4/1926 | Lumsden | 215/309 X |
| 1,676,711 | A | | 7/1928 | Reap | |
| 1,913,393 | A | | 6/1933 | Jones | |
| 2,036,310 | A | | 4/1936 | Werder | 221/100 |
| 2,051,513 | A | | 8/1936 | Bingham | |
| 2,165,570 | A | | 7/1939 | Olson et al. | 221/98 |
| 2,165,825 | A | | 7/1939 | Von Bultzingslowen | 221/60 |
| 2,239,921 | A | | 4/1941 | Majewski, Jr. | 221/67 |
| 2,328,110 | A | | 8/1943 | Thompson et al. | 225/21 |
| 2,364,400 | A | | 12/1944 | Stewart et al. | 226/116 |
| 2,401,914 | A | | 6/1946 | Di Pietro | 225/26 |
| 2,408,664 | A | | 10/1946 | Lloyd | 225/26 |
| 2,463,922 | A | | 3/1949 | Turner | 226/123 |
| 2,500,199 | A | | 3/1950 | Nesset | 128/272 |
| 2,520,003 | A | | 8/1950 | Gilmore | |
| 2,537,119 | A | | 1/1951 | Bauerlein et al. | 225/21 |
| 2,542,350 | A | | 2/1951 | Paulsen | |
| 2,543,390 | A | | 2/1951 | Van Vliet et al. | 222/129 |
| 2,558,700 | A | | 6/1951 | Burgess | 225/21 |
| 2,698,703 | A | | 1/1955 | Harvey | 222/207 |
| 2,718,985 | A | | 9/1955 | Tamminga | 222/131 |
| 2,724,535 | A | | 11/1955 | Day et al. | 226/124 |
| 2,749,096 | A | | 6/1956 | Cole | 257/241 |
| 2,754,999 | A | | 7/1956 | Bauerlein | 222/129.2 |
| 2,765,956 | A | | 10/1956 | Schmidtke | 222/41 |
| 2,778,545 | A | | 1/1957 | Sapia | 222/482 |
| 2,785,833 | A | | 3/1957 | Bauerlein et al. | 222/108 |
| 2,841,313 | A | | 7/1958 | Beall, Jr. | 222/479 |
| 2,857,084 | A | | 10/1958 | Harris | 222/481 |
| 2,880,912 | A | | 4/1959 | Fisher | 222/129.4 |
| 2,969,896 | A | | 1/1961 | Lerner | 222/520 |
| 2,989,243 | A | | 6/1961 | Turak | 239/113 |
| 3,074,700 | A | | 1/1963 | Buttner, Sr. et al. | 261/135 |
| 3,086,683 | A | | 4/1963 | Loper | 222/183 |
| 3,142,320 | A | | 7/1964 | Olson | 141/309 |
| 3,143,255 | A | | 8/1964 | Leeds | 222/479 |
| 3,225,950 | A | | 12/1965 | Josephsen et al. | 215/1 |
| 3,225,970 | A | | 12/1965 | Rooney | 222/484 |
| 3,258,166 | A | | 6/1966 | Kuckens | 222/70 |
| 3,292,527 | A | | 12/1966 | Stasse | 99/295 |
| 3,292,822 | A | | 12/1966 | Crowder et al. | 222/129.1 |
| D207,069 | S | | 2/1967 | Stettler | |
| 3,325,844 | A | | 6/1967 | Lampe | 15/50 |
| 3,326,417 | A | | 6/1967 | Tinsley | 222/54 |
| 3,341,073 | A | | 9/1967 | Arps et al. | 222/36 |
| 3,357,605 | A | | 12/1967 | Chadfield | 222/485 |
| 3,384,276 | A | | 5/1968 | Henningfield | 222/479 |
| 3,396,871 | A | | 8/1968 | McCann | 222/76 |
| 3,401,850 | A | | 9/1968 | Anderson | 222/482 |
| 3,439,843 | A | | 4/1969 | Corsette | 222/212 |
| 3,455,332 | A | | 7/1969 | Cornelius | 137/604 |
| 3,520,451 | A | | 7/1970 | Ashizawa | 222/148 |
| 3,536,500 | A | | 10/1970 | Cleereman et al. | 99/171 |
| 3,606,096 | A | | 9/1971 | Campbell | 222/153 |
| 3,618,905 | A | | 11/1971 | Primus | 261/153 |
| 3,628,444 | A | | 12/1971 | Mazza | 99/275 |
| 3,658,216 | A | | 4/1972 | Schwartzman | 222/453 |
| 3,664,550 | A | | 5/1972 | Carothers et al. | 222/129.2 |
| 3,669,315 | A | | 6/1972 | Kuckens | 222/148 |
| 3,685,694 | A | | 8/1972 | Ianelii | 222/82 |
| 3,690,520 | A | | 9/1972 | Sarris | 222/499 |
| 3,782,610 | A | * | 1/1974 | Gilbert | 222/484 |
| 3,800,826 | A | | 4/1974 | McCann | 137/560 |
| 3,834,596 | A | | 9/1974 | Brady et al. | 222/520 |
| 3,843,021 | A | | 10/1974 | Schieser | 222/105 |
| 3,887,116 | A | | 6/1975 | Ishikawa et al. | 222/520 |
| 3,941,171 | A | | 3/1976 | Ogle | 141/309 |
| 3,986,642 | A | | 10/1976 | Selvia et al. | 222/129.1 |
| 3,991,219 | A | | 11/1976 | Kuckens | 426/442 |
| 4,096,971 | A | | 6/1978 | Kuckens | 222/1 |
| 4,109,829 | A | | 8/1978 | Kuckens et al. | 222/81 |
| 4,113,129 | A | | 9/1978 | Cambio, Jr. | 215/1 |
| 4,121,507 | A | | 10/1978 | Kuckens | 99/275 |
| 4,125,334 | A | | 11/1978 | Jones | 366/181 |
| 4,141,461 | A | | 2/1979 | LaChance | 220/253 |
| 4,176,694 | A | | 12/1979 | Dickerson | 141/95 |
| 4,248,335 | A | | 2/1981 | Cornelius et al. | |
| 4,270,673 | A | | 6/1981 | Rodth | 222/129.3 |
| 4,328,909 | A | | 5/1982 | Jeans | 222/54 |
| 4,344,459 | A | | 8/1982 | Nelson | 138/45 |
| 4,355,735 | A | | 10/1982 | Whorton, III et al. | |
| 4,363,424 | A | | 12/1982 | Holben et al. | 222/4 |
| 4,378,079 | A | | 3/1983 | Kuckens | 222/333 |
| 4,408,701 | A | | 10/1983 | Jeans | 222/185.1 |
| 4,421,804 | A | | 12/1983 | Mori et al. | 428/35 |
| 4,457,343 | A | | 7/1984 | Zukausky | 138/45 |
| 4,488,584 | A | | 12/1984 | Hestehave et al. | 141/339 |
| 4,520,950 | A | | 6/1985 | Jeans | 222/129.1 |
| 4,523,697 | A | | 6/1985 | Jeans | 222/185 |
| 4,555,371 | A | | 11/1985 | Jeans | 261/122 |
| 4,564,483 | A | | 1/1986 | Jeans | 261/64 |
| 4,570,830 | A | | 2/1986 | Jeans | 222/185 |
| RE32,231 | E | | 8/1986 | Kuckens et al. | 222/81 |
| 4,613,063 | A | | 9/1986 | Wright | 222/153 |
| 4,624,395 | A | | 11/1986 | Baron et al. | 222/129.1 |
| 4,637,439 | A | | 1/1987 | Jeans | 141/18 |
| 4,660,742 | A | | 4/1987 | Ozdemir | |
| 4,664,292 | A | | 5/1987 | Jeans | 222/1 |
| 4,691,822 | A | | 9/1987 | Melancon, Jr. | 206/229 |
| 4,712,713 | A | | 12/1987 | Karlis et al. | 222/3 |
| D298,514 | S | | 11/1988 | Dole et al. | D9/403 |
| 4,802,610 | A | | 2/1989 | Cheek et al. | 222/481.5 |
| 4,805,793 | A | | 2/1989 | Brandt et al. | 215/10 |
| 4,805,808 | A | | 2/1989 | Larson | 222/185 |
| 4,865,211 | A | | 9/1989 | Hollingsworth | 220/8 |
| 4,874,023 | A | | 10/1989 | Ulm | 141/346 |
| D304,552 | S | | 11/1989 | Lippman | D9/403 |
| 4,911,212 | A | | 3/1990 | Burton | 141/369 |
| 4,993,565 | A | | 2/1991 | Ota et al. | 251/1 |
| 5,042,698 | A | | 8/1991 | Fessell | 222/481.5 |
| 5,067,622 | A | | 11/1991 | Garver et al. | 215/1 |
| 5,123,554 | A | | 6/1992 | Arvidson et al. | 215/12.2 |
| 5,141,121 | A | | 8/1992 | Brown et al. | 214/100 |
| 5,147,615 | A | | 9/1992 | Bird et al. | 422/261 |
| D330,483 | S | | 10/1992 | Plester et al. | D7/398 |
| D331,516 | S | | 12/1992 | Waring | D6/545 |
| 5,222,615 | A | | 6/1993 | Ota et al. | 215/1 C |
| 5,224,614 | A | | 7/1993 | Bono et al. | 215/100 A |
| 5,224,854 | A | | 7/1993 | Ansquer | |
| 5,251,789 | A | | 10/1993 | Jeans | |

| | | | | | |
|---|---|---|---|---|---|
| D341,775 | S | | 11/1993 | Wolde et al. | D6/542 |
| D342,176 | S | | 12/1993 | Steiner et al. | D9/516 |
| 5,425,404 | A | * | 6/1995 | Dyer | 141/351 |
| 5,435,451 | A | | 7/1995 | Dyer | 215/400 |
| D369,110 | S | | 4/1996 | Dyer | D9/520 |
| 5,715,877 | A | * | 2/1998 | Sandor | 141/351 X |

FOREIGN PATENT DOCUMENTS

| | | |
|---|---|---|
| DE | 1136906 | 9/1962 |
| DE | 2557961 | 6/1977 |
| EP | 0 010 912 | 5/1980 |
| EP | 0 356829 | 3/1990 |
| FR | 1 174 882 | 3/1959 |
| FR | 2 373 486 | 7/1978 |
| GB | 428722 | 5/1935 |
| GB | 631170 | 10/1949 |
| GB | 635966 | 4/1950 |
| GB | 659764 | 10/1951 |
| GB | 797340 | 7/1958 |
| GB | 1049118 | 11/1966 |
| GB | 1367814 | 9/1974 |
| GB | 1514404 | 6/1978 |
| GB | 1534361 | 12/1978 |
| GB | 1534362 | 12/1978 |
| GB | 1537699 | 1/1979 |
| GB | 2030962 A | 4/1980 |
| GB | 2037255 A | 7/1980 |
| GB | 2103296 A | 2/1983 |
| WO | WO 90/08098 | 7/1990 |

OTHER PUBLICATIONS

"Twist 'N Fill ™ II Valve with Lock/Key Tabs" by Duncan Toll, including photographs, 5 page document (Date Unknown).

Twist'n Fill II Confidential Feature Development Outline #1, by Duncan Toll, 2 page document (Date Unknown).

Article from Chemical Engineering Handbook date 1959 entitled, "Make an Easy–to–Build Butterfly Valve," by K.J. Johnson, p. 107. Exhibit A.

Hydro Systems Company document entitled "Hydro® OmniClean Streamline Series," 4 pages, dated Feb. 1990. Exhibit B.

Sodamate Instruction Manual for the Care and Use of Your Carbonated Beverage Dispenser, 10 pages. Exhibit C.

Photographs of a dispensing valve by Champion. Exhibit D.

* cited by examiner

GRAVITY FEED FLUID DISPENSING VALVE

This is a divisional of application Ser. No. 08/946,759 filed Oct. 8, 1997.

FIELD OF THE INVENTION

This invention relates generally to systems for dispensing fluids, and more particularly to valve caps and bottles for use in gravity feed fluid dispensing systems.

BACKGROUND OF THE INVENTION

Gravity feed fluid dispensing systems are known for dispensing a concentrated fluid for mixing with a dilutant. An example of such a system is shown in U.S. Pat. No. 5,425,404 issued Jun. 20, 1995 to Minnesota Mining & Manufacturing Company of St. Paul, Minn., entitled, "Gravity Feed Fluid Dispensing System." U.S. Pat. No. 5,435,451 issued Jul. 25, 1995, and U.S. Pat. No. Des. 369,110 issued Apr. 23, 1996, both to Minnesota Mining & Manufacturing Company relate to a bottle for use in the gravity feed fluid dispensing system of U.S. Pat. No. 5,425,404.

Generally, the gravity feed fluid dispensing system of U.S. Pat. No. 5,425,404 includes an inverted bottle containing concentrated fluid, with an opening closed off by a valve cap. The system further includes a dispenser assembly which cooperates with the bottle and the valve cap during use. The valve cap controls the flow of the concentrated fluid from the bottle into the dispenser assembly for mixing with dilutant, such as water. The concentrate may be any of a wide variety of material, such as cleaning fluids, solvents, disinfectants, insecticides, herbicides, or the like. The diluted fluid exits the dispenser assembly into a container, such as a bucket or spray bottle, for use as desired.

Various concerns arise in connection with the valve cap. One concern is that the valve cap allow for metering of the concentrate from the bottle so that a proper ratio of the fluids results. Related concerns are that the valve cap only allow dispensing of the concentrate at the desired time, and that the valve cap be easy to use. Cost of the valve is also a concern since it is often desirable that the bottle with the valve cap be disposable after use. A further concern is whether any features are provided with the valve cap to prevent or deter undesired or inadvertent dispensing. There is a need in the art for further valve caps which address the above concerns, and other concerns.

SUMMARY OF THE INVENTION

One aspect of the present invention concerns a dispensing valve cap for use with a bottle containing fluid for dispensing the fluid in a gravity feed fluid dispensing system where the valve cap includes two valve parts. A first valve part is mountable to the bottle, and a second valve part is rotatably mounted to the first valve part. The first valve part includes a tubular portion which includes an air inlet aperture and a fluid outlet aperture through the tubular portion. The air inlet aperture and the fluid outlet aperture are spaced apart from each other along a longitudinal axis of the tubular portion. The second valve part includes a mating portion adapted to cooperate with the first valve part to open and close the air inlet aperture and the fluid outlet aperture of the first valve part.

A further aspect of the present invention concerns a tamper resistant dispensing valve cap for use with a bottle containing fluid for dispensing the fluid in a gravity feed fluid dispensing system where the valve cap includes two valve parts. A first valve part is mountable to the bottle and includes at least one arcuate slot and a locking notch at one end of the slot. The first valve part further includes an air inlet and a fluid outlet. A second valve part is rotatably mounted to the first valve part and includes a mating portion adapted to cooperate with the first valve part to open and close the air inlet and fluid outlet of the first valve part. The second valve part further includes a locking tab positionable either in the arcuate slot so as to dispense fluid, or in the notch so as to lock the second valve part from movement relative to the first valve part. The air inlet and the fluid outlet of the first valve part are open when the tab is positioned in the arcuate slot at the end opposite the locking notch. The air inlet and the fluid outlet of the first valve part are closed when the tab is positioned in the notch.

Another aspect of the invention relates to a valve cap for use with a bottle containing fluid for dispensing the fluid in a gravity feed fluid dispensing system where the valve cap includes first and second valve parts rotatably mounted together with a snap arrangement where the second valve part is adapted to cooperate with the first valve part to open and close an air inlet and a fluid outlet of each of the first and second valve parts. An orifice insert member is trapped between the first and second valve parts. The orifice insert member includes a fluid control aperture having a predetermined size for the fluid to be dispensed from the bottle. The fluid control aperture communicates with the fluid outlets of the first and second valve parts during fluid dispensing.

The present invention also relates to a method of dispensing fluid from a bottle including rotating one tubular member of a valve on the bottle relative to another tubular member to simultaneously open an air inlet and a fluid outlet of the valve. The fluid is dispensed from the bottle under gravity, and air enters the bottle from the atmosphere. The dispensed fluid is mixed with dilutant. The one tubular member is rotated relative to the other to simultaneously close the air inlet and the fluid outlet of the valve at the desired time to stop dispensing.

A further method includes providing a bottle containing fluid therein, with the bottle having a tamper resistant valve in fluid communication with an interior of the bottle. The method further includes mounting the bottle to a dispenser assembly, engaging a portion of the valve with the dispenser assembly to unlock a lock of the valve during mounting of the bottle to the dispenser assembly, and rotating a first portion of the unlocked valve relative to a second portion of the valve. The fluid is dispensed from the bottle under gravity through the unlocked and rotated valve, and air is allowed to enter the bottle from the atmosphere. The fluid dispensed from the bottle is mixed with dilutant supplied by the dispenser assembly.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE INVENTION

Referring now to FIGS. 1–5, there is shown a preferred embodiment of a fluid dispensing system including a fluid dispenser assembly 12 and a bottle 14 containing a quantity of a fluid that is to be dispensed. Typically, the fluid is provided in a concentrated form with the intention that the concentrate will be diluted with at least one other diluting fluid prior to being dispensed and used. The concentrate in bottle 14 may be any of a wide variety of materials, such as cleaning fluids, solvents, disinfectants, insecticides, herbicides, or the like. The dilutant may be water or any other suitable fluid. Generally, dispenser assembly 12 is constructed in accordance with U.S. Pat. No. 5,425,404, the disclosure of which is incorporated by reference.

Figure 1:
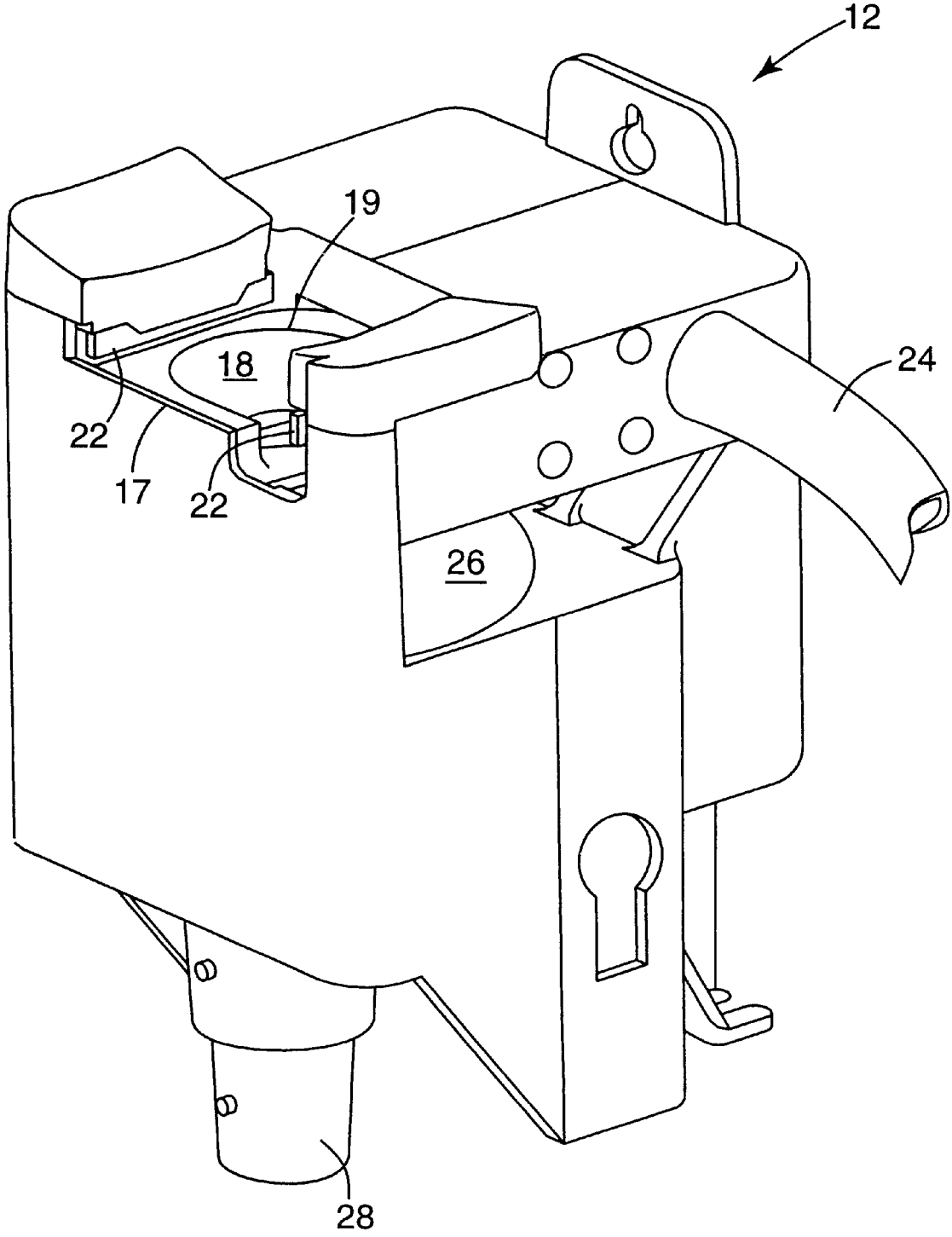
FIG. 1 PRIOR ART
FIG. 1 is a perspective view of a prior art dispenser assembly.
Figure 2:
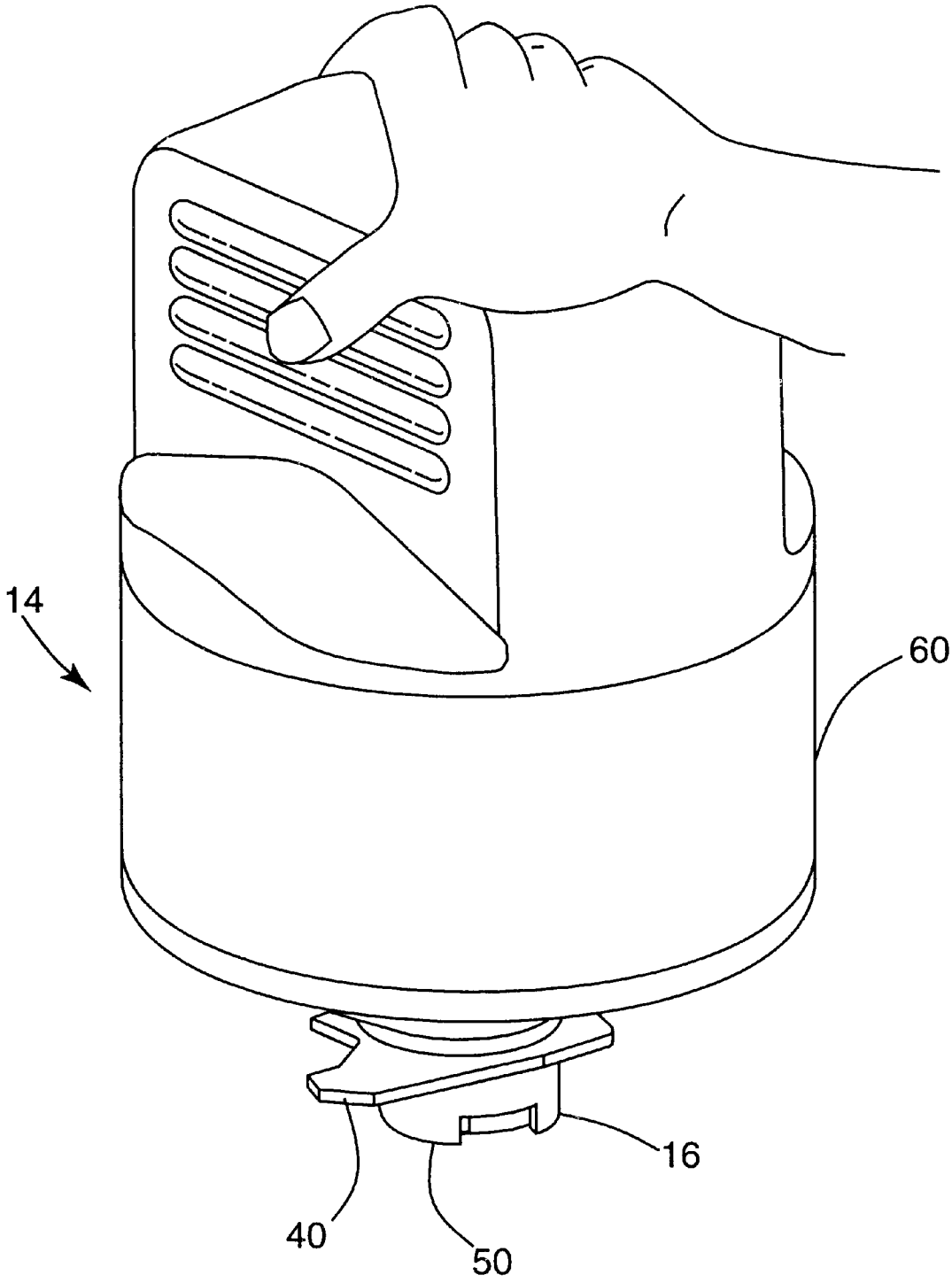
FIG. 2 is a perspective view of a preferred embodiment of a bottle with a valve cap according to the present invention.
Figure 3:
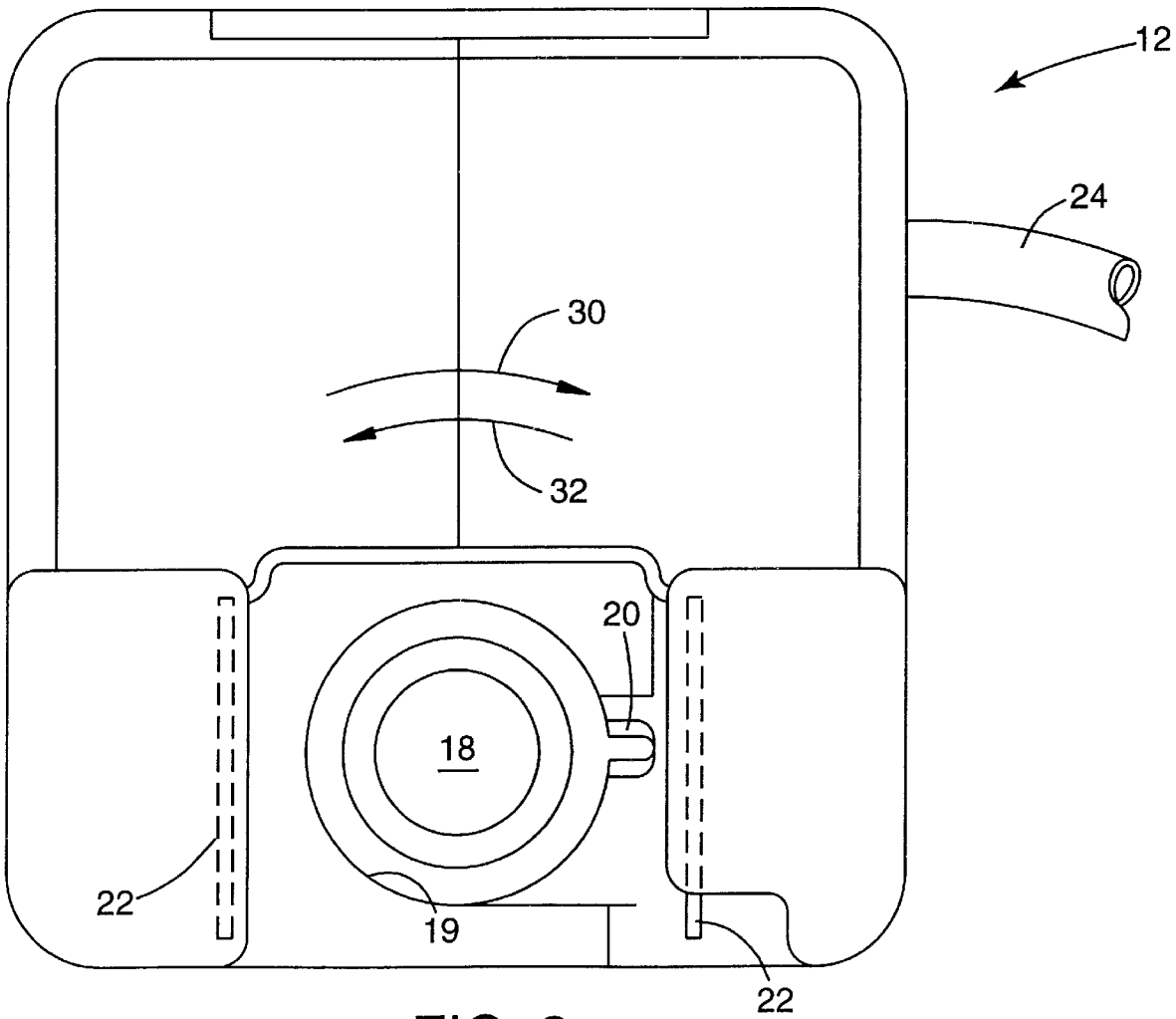
FIG. 3 PRIOR ART
FIG. 3 is a top view of the dispenser assembly of FIG. 1, showing directional arrows for the movement of the bottle with valve cap of FIG. 2 during use.

Bottle 14 of the present invention includes a valve cap 16 for controlling dispensing of concentrate from bottle 14. Bottle 14 with valve cap 16 cooperates with dispenser assembly 12 during use to dispense and dilute the concentrate. Specifically, bottle 14 is inverted as shown in FIG. 2, and valve cap 16 is inserted into a chamber 18 defined by a main body 17 of dispenser assembly 12. Chamber 18 has a generally cylindrically-shaped sidewall 19. Valve cap 16 generally includes a first valve part 40 (FIG. 4) which mounts to a bottle 60 of bottle 14 for rotation with bottle body 60 during use. Valve cap 16 also includes a second valve part 50 (FIG. 4) mounted to first valve part 40 for relative movement so as to open and close valve cap 16. During use of bottle 14 with dispenser assembly 12, a side projection or tab 52 on second valve part 50 resides in a notch 20 of dispenser assembly 12 to define a hold down arrangement for second valve part 50. To operate valve cap 16 between closed (FIG. 4) and open (FIG. 5) positions, bottle 14 is rotated, preferably by the user grasping bottle body 60 as shown in FIG. 2, and rotating bottle body 60 in the direction of arrow 30 (FIG. 3) to open valve cap 16. Rotation of bottle body 60 in the direction of arrow 32 (FIG. 3) returns valve cap 16 to the closed position.

Rotation of bottle body 60 rotates first valve part 40 about a longitudinal axis 41 relative to second valve part 50 held from rotation by tab 52 positioned within notch 20 of dispenser assembly 12. Rotation of bottle body 60 also rotates a camming flange 42 extending from first valve part 40. Camming flange 42 selectively operates a dilutant valve 22 which controls the flow of dilutant from an inlet 24 to dispenser assembly 12 to enter a mixing chamber 26 of dispenser assembly 12. Dispenser assembly 12 includes two dilutant valves 22, each of which is linked to inlet 24 of dispenser assembly 12. Concentrate flows from within bottle 14 through valve cap 16 into mixing chamber 26 when second valve part 50 is moved relative to the first valve part 40 thereby opening valve cap 16. Air from the atmosphere enters bottle 14 through valve cap 16 as concentrate is dispensed. The concentrate and the dilutant are mixed within mixing chamber 26 and exit dispenser assembly 12 together at an outlet 28. Bottle body 14 is rotated back in the opposite direction to close valve cap 16, and to release camming flange 42 from engagement with each dilutant valve 22. Each dilutant valve 22 is spring loaded such that each dilutant valve automatically closes when bottle 14 is rotated back to the closed position. It is to be appreciated that other dispenser assemblies are possible for use with bottle 14 where the dispenser assembly holds second valve part 50 during rotation of bottle body 60, first valve part 40, and camming flange 42.

Figure 5:
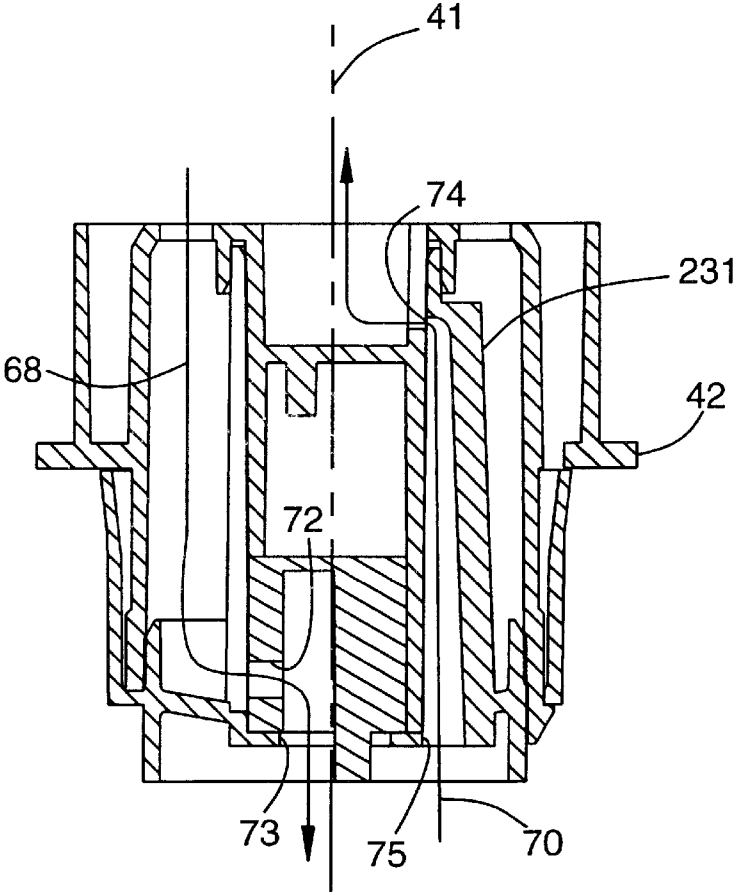
FIG. 5 is a cross-sectional view of the valve cap as in FIG. 4 showing the valve cap in the open position.
Figure 4:
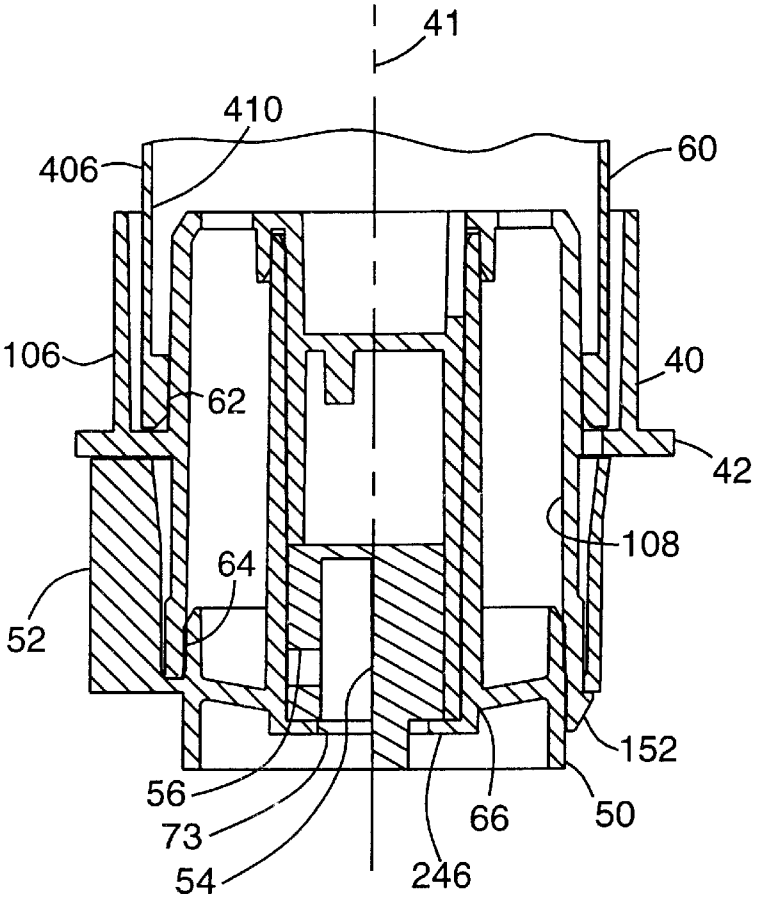
FIG. 4 is a cross-sectional side view through the valve cap and a portion of the bottle, with the valve cap in the closed position.
Figure 6:
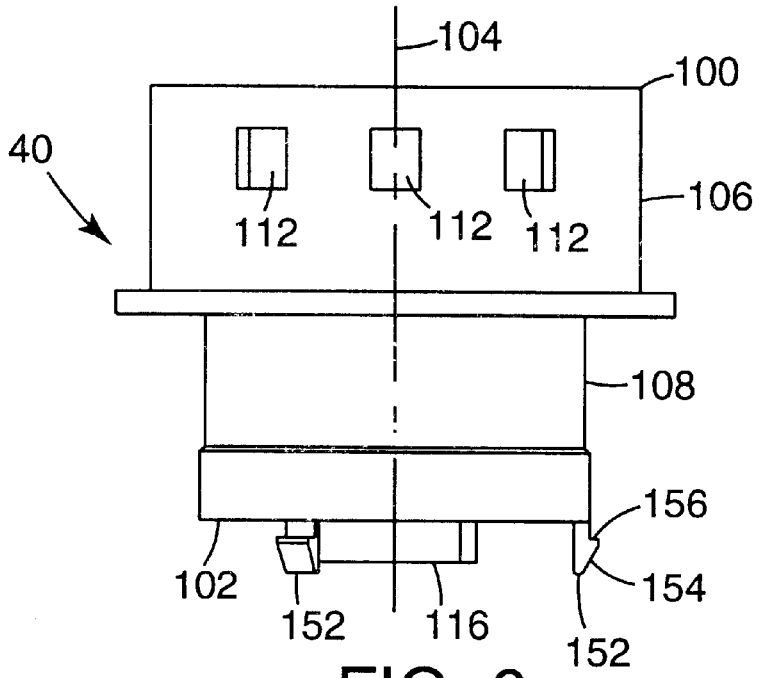
FIG. 6 is a side view of a first valve part of the valve cap.
Figure 11:
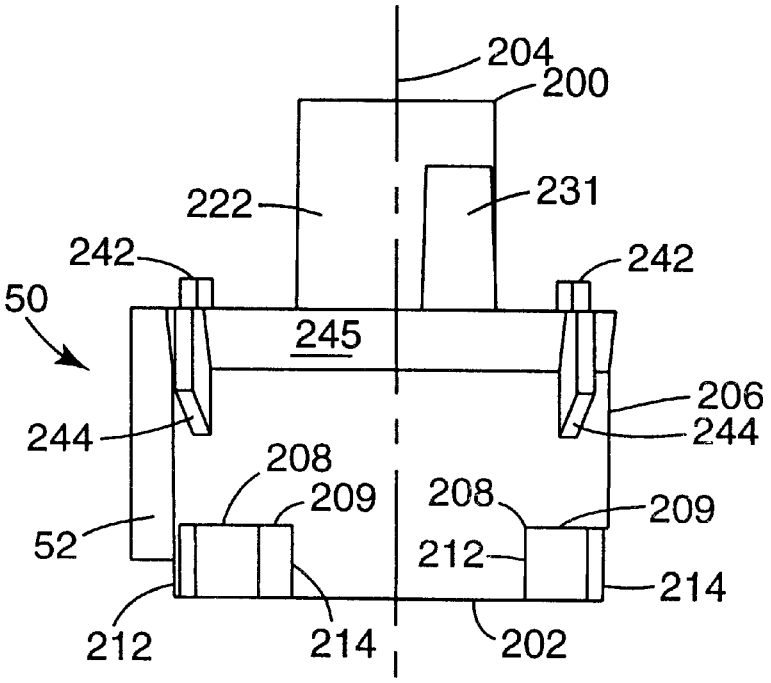
FIG. 11 is a side view of the second valve part of the valve cap.
Figure 7:
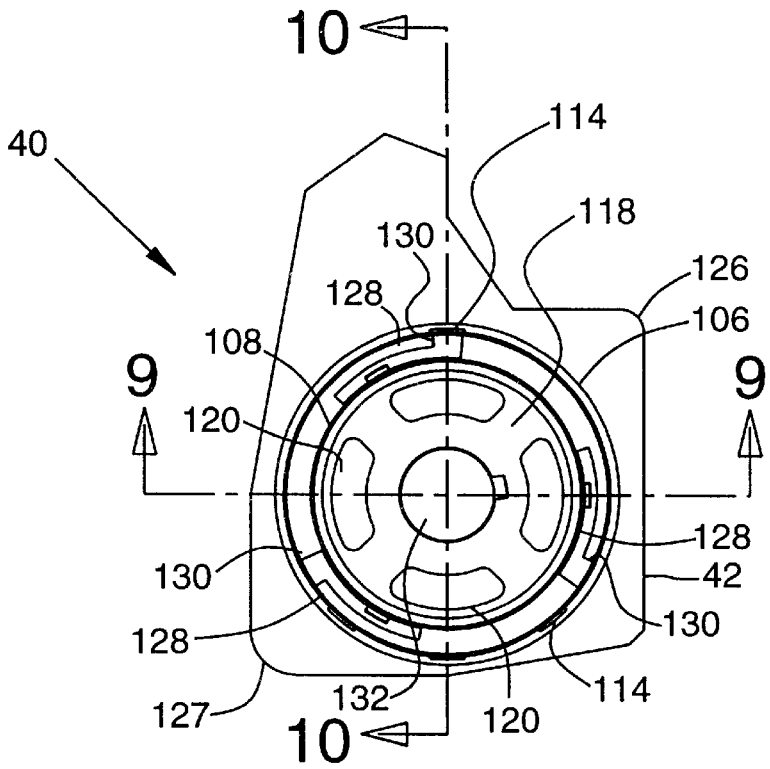
FIG. 7 is a top view of the first valve part.
Figure 8:
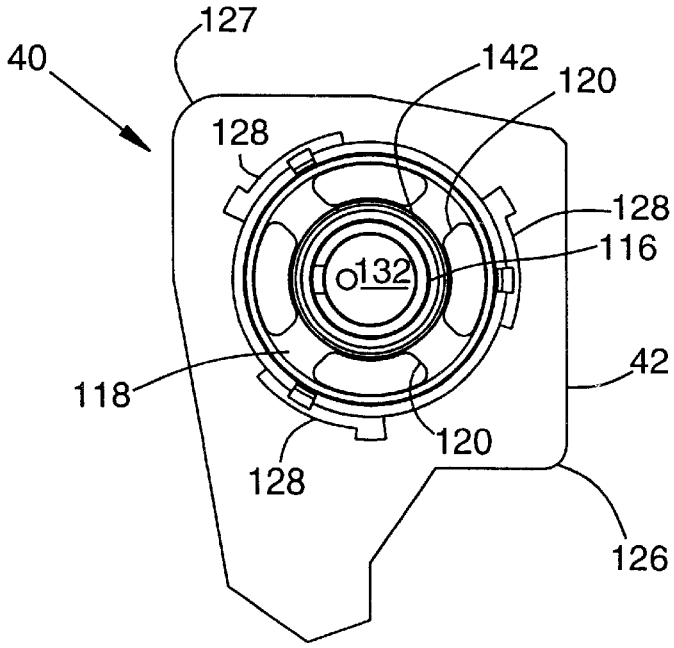
FIG. 8 is a bottom view of the first valve part.
Figure 9:
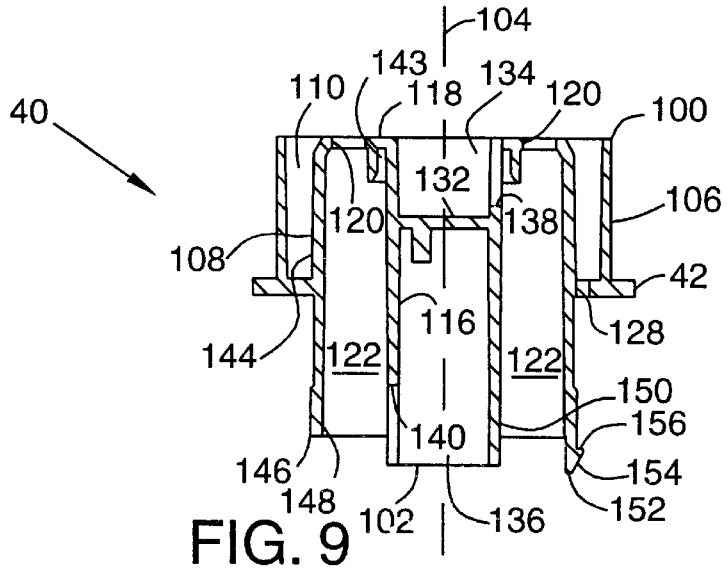
FIG. 9 is a cross-sectional side view of the first valve part taken along lines 9—9 of FIG. 7.
Figure 10:
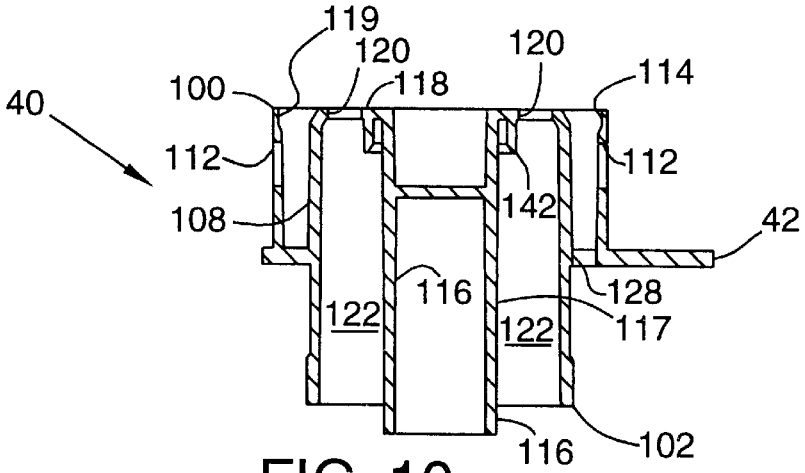
FIG. 10 is a cross-sectional side view of the first valve part taken along lines 10—10 of FIG.7.

Referring now to FIGS. 4 and 5, valve cap 16 is shown both in the closed position (FIG. 4), and in the open position (FIG. 5). FIG. 4 illustrates three seal regions 62, 64, and 66 for sealing an interior of bottle 14 at valve cap 16 from an exterior. Seal regions 62, 64, and 66 will be discussed in more detail below. FIG. 5 illustrates the fluid flow path out of bottle 14 represented by arrow 68 through a fluid outlet 72 and a central opening 73, and the airflow path into bottle 14 represented by arrow 70 from side opening 75 through an air inlet 74. The fluid flow path and the airflow path will be discussed in more detail below. Generally, valve cap 16 allows fluid outflow under the effects of gravity, since fluid outlet 72 is disposed vertically below air inlet 74. Air from the atmosphere enters bottle 14 at air inlet 74 as fluid is dispensed. Valve cap 16 may be referred to as a "constant head valve" since the fluid level within bottle 14 above air inlet 74 does not impact the fluid outflow rate. FIGS. 4 and 5 also illustrate an orifice insert 54 of valve cap 16 including a metering opening 56 for all of the fluid to pass through for precise metering of fluid exiting bottle 14. Metering opening 56 is provided with a predetermined size to allow for the desired flow rate of fluid from bottle 14.

Valve cap 16 of the preferred embodiment includes generally tubular-shaped and concentrically arranged components which rotate between positions so as to open and close valve cap 16. Tubular portions which rotate relative to each other to open and close fluid outlet 72 and air inlet 74 allow for convenient sealing to occur between the surfaces without additional gaskets. Also, slideable tubular surfaces do not "squirt" concentrate like a planar surface does when moved toward an aperture to close a valve. The tubular portions are generally cylindrical in the preferred embodiment, although some angles and tapers may be provided to facilitate appropriate fluid tight seals, and manufacture from molded materials. Steeper angles, or more conically-shaped components, are also possible wherein rotation of the two parts occurs with respect to a common axis, as in the preferred embodiment shown.

Tamper resistant features are also provided with valve cap 16 in the preferred embodiment. The tamper resistant features prevent undesired or inadvertent dispensing by locking second valve part 50 to first valve part 40 in the closed position. Preferably, the tamper resistant features are deactivated automatically upon insertion of valve cap 16 into dispenser assembly 12.

Preferably, first valve part 40 and second valve part 50 snap together during assembly. The snap arrangement also conveniently traps orifice insert 54 in position. Preferably, valve cap 16 snaps to bottle body 60 for further ease of assembly.

Figure 28:
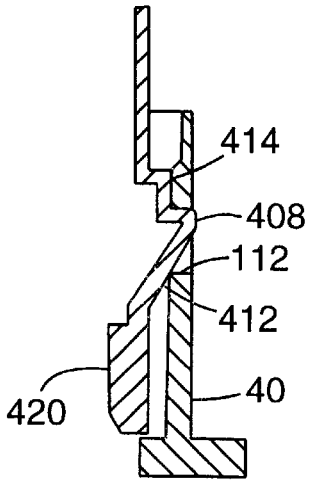
FIG. 28 is an enlarged cross-sectional side view of a portion of the neck of the bottle and a portion of the valve cap mounted to the bottle.
Figure 25:
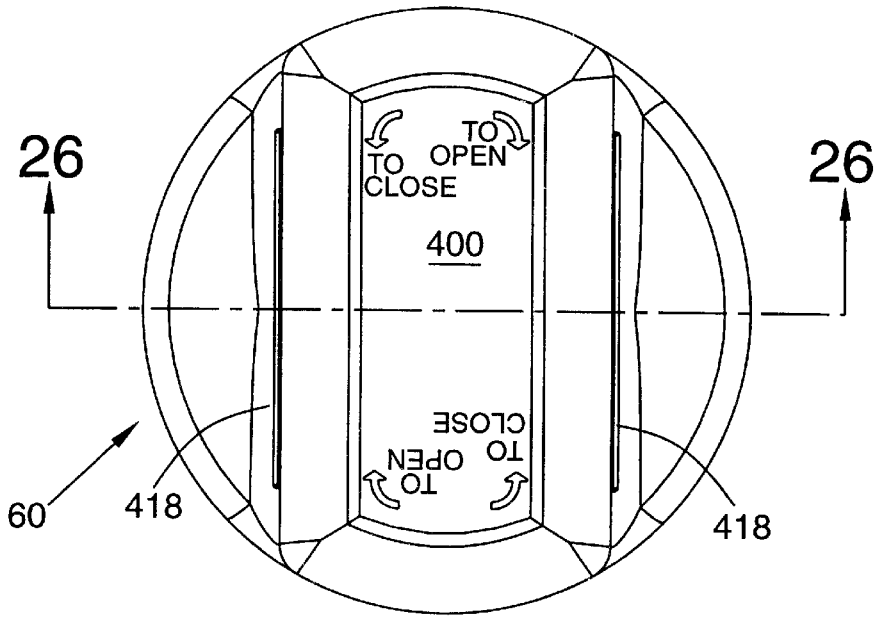
FIG. 25 is a top view of the bottle.
Figure 26:
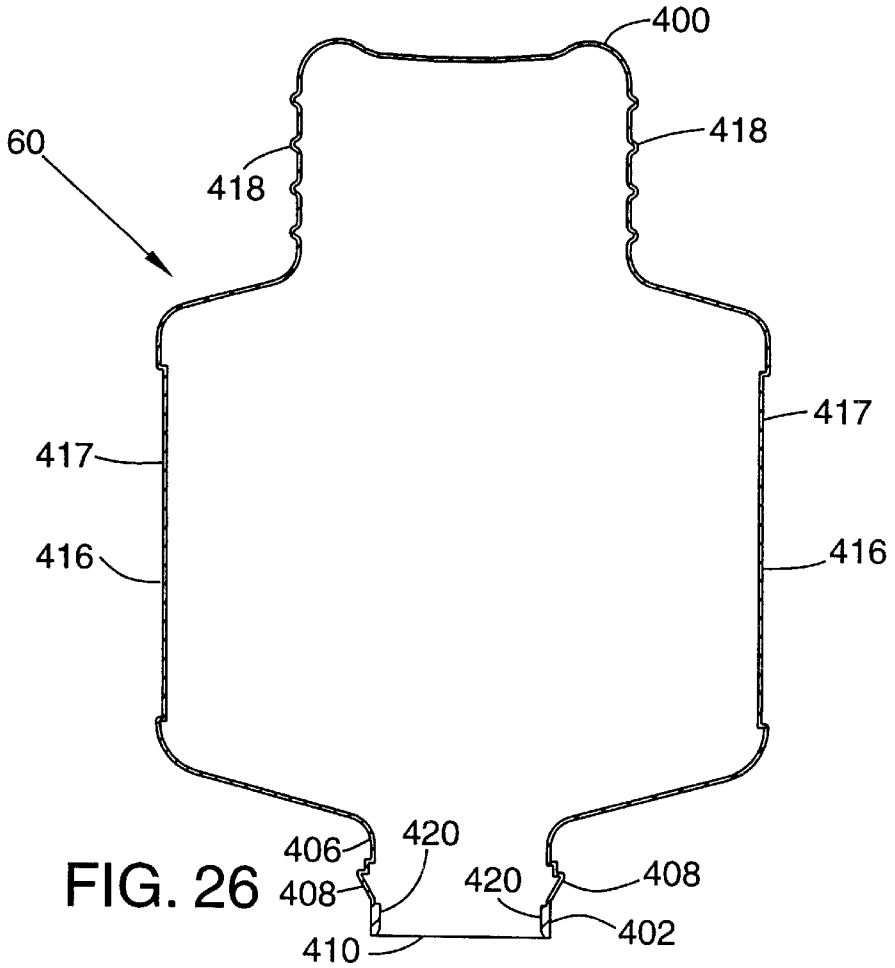
FIG. 26 is a cross-sectional side view of the bottle taken along lines 26—26 of FIG. 25.

Referring now to FIGS. 6–22, further details of valve cap 16 are shown. FIGS. 6–10 illustrate first valve part 40; FIGS. 11–16 illustrate second valve part 50; and FIGS. 17–22 illustrate two embodiments for orifice insert 54. Now with specific reference to FIGS. 4–10, first valve part 40 includes an upper end 100, an opposite lower end 102, and a longitudinal central axis 104. Adjacent to upper end 100 of first valve part 40 is structure for mounting first valve part 40 to bottle body 60. First valve part 40 includes a bottle collar 106 and a first tube 108 inside of bottle collar 106. Between bottle collar 106 and first tube 108 is a space 110 for receiving a neck 406 of bottle body 60 (see FIG. 4). Four apertures 112 through bottle collar 106 receive four projections 408 of bottle body 60 (see FIG. 28, for example). To facilitate alignment and attachment of first valve part 40 to bottle body 60, small notches 114 are provided on an inside surface 119 of bottle collar 106. When first valve part 40 is mounted to bottle body 60, an orifice 410 of neck 406 of bottle body 60 is in fluid communication and airflow communication with first valve part 40. Bottle collar 106 is generally tubular in shape. Additional projections 408 and apertures 112 are possible. Fewer projections 408 and apertures 112 are also possible, including just one of each.

First valve part 40 further includes an inner second tube 116 extending generally concentrically relative to first tube 108. A web 118 links first tube 108 to second tube 116. Web 118 defines a plurality of apertures 120 which facilitate fluid flow from bottle 14. A chamber 122 is defined between first tube 108 and second tube 116.

To operate one or more dilutant valves 22 associated with dispenser assembly 12, first valve part 40 is provided with camming flange 42 including two camming lobes 126, 127 for engagement with each dilutant valve 22 upon rotation of camming flange 42 relative to dispenser assembly 12. A single lobe is also possible if desired to only operate one of dilutant valves 22.

Tamper resistant features are provided in connection with first valve part 40. Located on camming flange 42 between bottle collar 106 and first tube 108 are a plurality of locking slots 128, and locking notches 130. Locking slots 128 are arcuate in shape and have a length equal to the amount of rotation of second valve part 50 relative to first valve part 40 during use. Each locking notch 130 is positioned at one end of the respective locking slot 128. The tamper resistant features of first valve part 40 will be described in more detail below in connection with the discussion of second valve part 50.

Second tube 116 of first valve part 40 includes a divider 132 generally transverse to longitudinal axis 104. Divider 132 forms second tube 116 into an upper chamber 134 and a lower chamber 136. An air inlet or airflow aperture 138 passes through second tube 116 adjacent to upper chamber 134. A fluid outlet or fluid flow aperture 140 passes through second tube 116 adjacent to lower chamber 136.

First valve part 40 includes a strengthening lip 142 adjacent to upper end 100. Strengthening lip 142 traps a portion of second valve part 50 between an inside surface of strengthening lip 142, and second tube 116 in a chamber 143 to facilitate fluid tight seals in valve cap 16. Strengthening lip 142 surrounds at least a portion of second valve part 50, and preferably completely surrounds an end. Preferably, strengthening lip 142 is tubular in shape.

First valve part 40 includes several surfaces for providing a fluid tight seal during operation. A bottle sealing surface 144 on first tube 108 cooperates with bottle body 60 to provide fluid tight seal 62. A lower lip 146 of first tube 108 includes an inner sealing surface 148 for providing outer fluid tight seal 64 between first valve part 40 and second valve part 50. Outside sealing surface 150 of second tube 116 seals against second valve part 50 to provide inner fluid tight seal 66 between first valve part 40 and second valve part 50.

To mount first valve part 40 to second valve part 50, a plurality of locking clips 152 are provided extending longitudinally from first tube 108 adjacent to lower end 102. Each locking clip 152 includes a ramp surface 154 and a locking shoulder 156 for engagement with an edge provided on second valve part 50, as will be discussed in more detail below. Locking clips 152 are preferably equally spaced about first tube 108. In the embodiment shown, three equally spaced locking clips 152 are provided.

Referring now to FIGS. 4, 5, and 11–16, second valve part 50 includes an upper end 200, an opposite lower end 202, and a longitudinal central axis 204. A first tube 206 supports projection 52 which is engaged by dispenser assembly 12 to hold second valve part 50 relative to dispenser assembly 12 while bottle body 60 and first valve part 40 are rotated. First tube 206 includes end notches 208 each having a lower edge 209 to receive locking clips 152 of first valve part 40. Lower edge 209 engages shoulder 156 of each locking clip 152 of first valve part 40. Sides 212, 214 of each notch 208 define the range of rotation permitted between second valve part 50 and first valve part 40. During use, locking clips 152 are permitted to move back and forth within each respective notch 208 during relative rotation of second valve part 50 and first valve part 40. During assembly, first valve part 40 snaps to second valve part 50 with locking clips 152 received in notches 208.

Adjacent to lower end 202 of second valve part 50, a sealing lip 216 extends toward upper end 200. Sealing lip 216 is spaced inwardly from first tube 206 and defines a chamber 218 for receipt of lower lip 146 of first valve part 40. Sealing lip 216 includes an outer sealing surface 220 which seals against inner sealing surface 148 of lower lip 146 to provide the outer fluid tight seal 64 between the valve parts.

Second valve part 50 further includes an inner second tube 222 linked to sealing lip 216 via connecting portion 224. Sealing lip 216 is further connected to first tube 206 via connecting sections 226 which are spaced apart to define gaps 227 the same length as notches 208 for receipt of locking clips 152.

Second tube 222 of second valve part 50 defines a central passage 228. An offset passage 230 defined by a side projection 231 extends from second tube 222 from lower end 202 up to a point adjacent to upper end 200 for defining an airflow path for air entering bottle 14. Second tube 222 includes a slot 232 extending from upper end 200 to a point adjacent to lower end 202. A lower portion 233 of slot 232 defines a fluid passage for fluid exiting bottle 14. Slot 232 need not extend to upper end 200. Although, for ease of manufacturing, such may be desired. Upper lip 234 formed on an end of second tube 222 of second valve part 50 is received by chamber 143 between strengthening lip 142 of first valve part 40 and second tube 116 of first valve part 40. When second valve part 50 is mounted to first valve part 40, lower portion 233 of slot 232 is alignable with aperture 140 of first valve part 40 to provide a fluid flow path from an interior of bottle 14 to an exterior. The construction of side projection 231, offset passage 230 and second tube 222 cooperates with an exterior surface 117 of second tube 116 of first valve part 40 to define an airflow passage extending from lower end 202 of second valve part 50 up to aperture 138 of first valve part 40 to provide an airflow path from an exterior of bottle 14 to an interior. An inside surface 240 of second tube 222 sealingly engages outside sealing surface 150 of second tube 116 of first valve part 40 to form the inner fluid tight seal 66 between the valve parts. Offset passage 230 is tapered in the preferred embodiment.

Second valve part 50 includes a plurality of locking tabs 242 extending from an upper end of first tube 206. Locking tabs 242 cooperate with locking slots 128 and locking notches 130 of first valve part 40 to provide the tamper resistant features. Locking tabs 242 also include deactivation ramps 244 which permit unlocking of second valve part 50 relative to first valve part 40 upon insertion of bottle 14 into dispenser assembly 12. First tube 206 is preferably outwardly tapered at upper lip 245.

Referring now to FIGS. 17–22, two embodiments of orifice insert 54, 54*a* are shown. Insert 54 of FIGS. 17–20 includes an upper end 300, a lower end 302, and a central axis 304. Insert 54 includes a generally cylindrical body 306 including a side projection 308. Side apertures 310*a*, 310*b* comprise metering opening 56 and link an exterior of orifice insert 54 to an inner chamber 312. Only a single opening is illustrated in FIGS. 4 and 5 for orifice insert 54. For some flow rates, only one opening may be desired. Inner chamber 312 communicates with an open end 314 of orifice insert 54. During use, generally cylindrical body 306 is received within lower chamber 136 defined by second tube 116 of first valve part 40. Side projection 308 resides in aperture 140. Second valve part 50 includes an inwardly projecting radial lip 246 for trapping orifice insert 54 in position. A projecting post 316 allows for convenient handling of orifice insert 54. Post 316 also functions as a drain post for directing the fluid out of the valve cap in a vertical direction.

Figure 20:
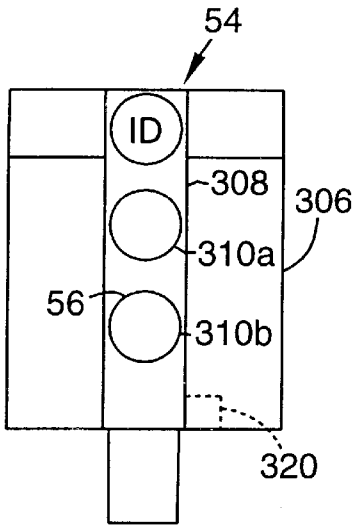
FIG. 20 is another side view of the orifice insert.
Figure 19:
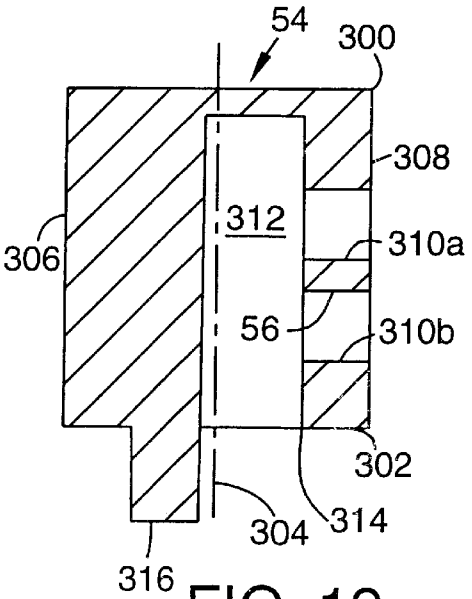
FIG. 19 is a cross-sectional side view of one embodiment of the orifice insert taken along lines 19—19 of FIG. 17.
Figure 24:
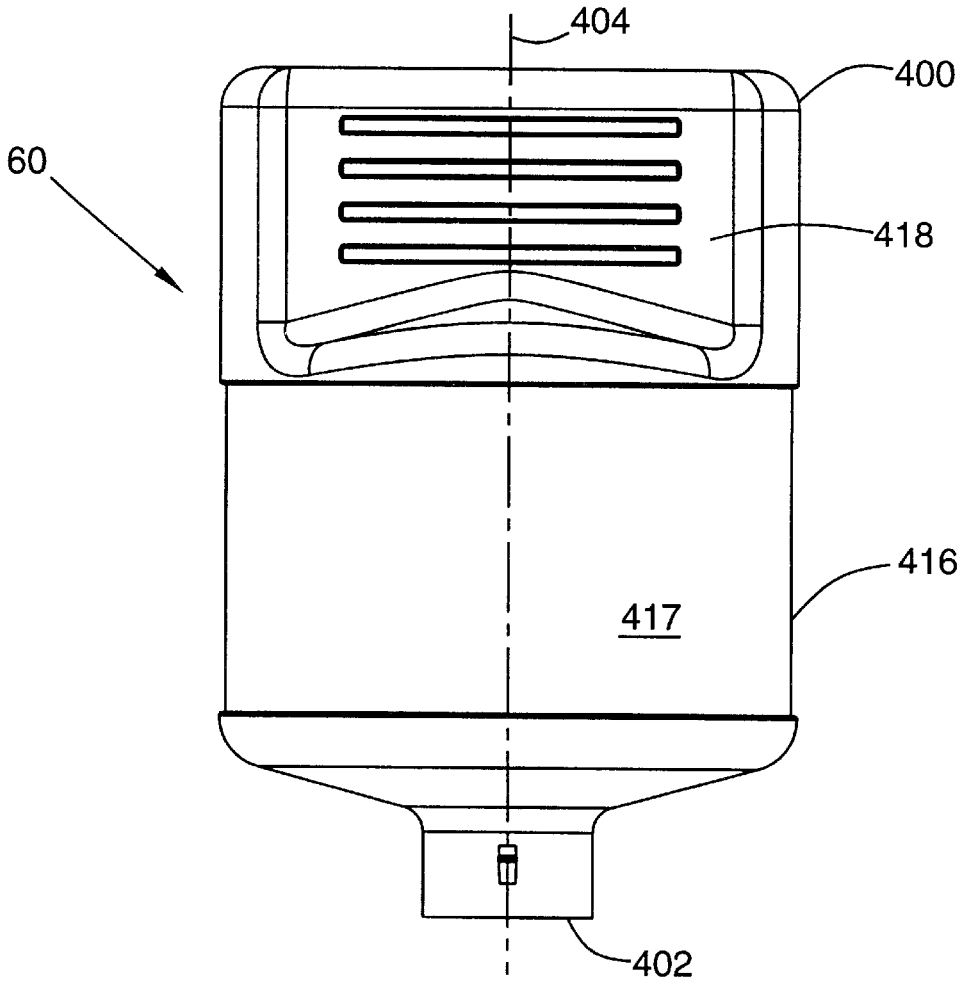
FIG. 24 is a side view of the bottle.

Side apertures 310*a*, 310*b* of orifice insert 54 define a predetermined metering opening which permits precise control of fluid exiting from bottle 14 during use. As shown in FIGS. 19 and 20, orifice insert 54 includes two apertures 310*a*, 310*b*. Only one (see FIGS. 4 and 5) or more than two may be provided. By the use of one or more apertures, and by providing different sizes and shapes to the aperture or apertures, fluid flow rate control is provided. Other shapes besides circular apertures can be provided to control flow in orifice insert 54. For example, orifice insert 54*a* illustrated in FIGS. 21 and 22 includes a slot-shaped aperture 430 specially sized for a desired flow rate.

An advantage of providing orifice insert 54 separate from first valve part 40 or second valve part 50 is that molded plastic valve caps 16 in accordance with the invention can be provided with different flow rates without individually molding first valve part 40 or second valve part 50 of each valve cap 16 with different orifice sizes. Instead, standard first valve parts 40 and second valve parts 50 can be provided, all of the same size and made from the same mold shape. Different molds of orifice insert 54 are then provided for molding each differently sized aperture for the different orifice inserts 54. In the embodiment shown, the mold for orifice insert 54 is less complex and easier to construct than the molds for first valve part 40 and second valve part 50. Orifice control could be provided with respect to first valve part 40 or second valve part 50, but that would necessitate multiple molds or the use of different mold pieces for one or the other to vary the orifice size. As one example, thirty or forty different orifice sizes may be desired to control dispensing of many different materials for dispensing through dispenser assembly 12. For example, apertures 310*a*, 310*b* may range from about 0.039 inches to 0.122 inches in diameter, and aperture 430 may range in height from about 0.207 inches to 0.419 inches and with a uniform width of about 0.150 inches. A suitable plastic for first valve part 40, second valve part 50 and insert 54 is high density polyethylene, polypropylene, or other moldable plastic.

Orifice insert 54 conveniently cooperates with first valve part 40 and second valve part 50 during assembly. Cylindrical body 306 slides into position within the generally cylindrical shape of second tube 116 of first valve part 40. Side projection 308 slides into position in aperture 140 of first valve part 40. When second valve part 50 is snapped to first valve part 40, orifice insert 54 is conveniently trapped in position.

Figure 17:
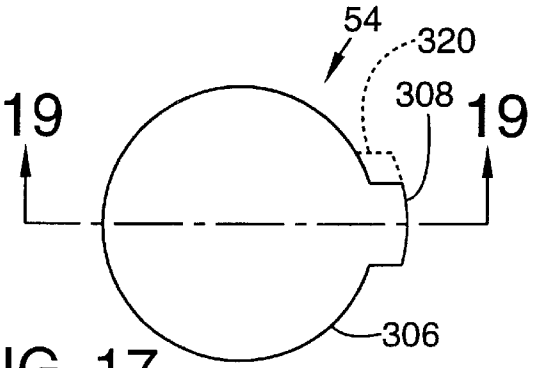
FIG. 17 is a top view of the orifice insert of the valve cap.
Figure 22:
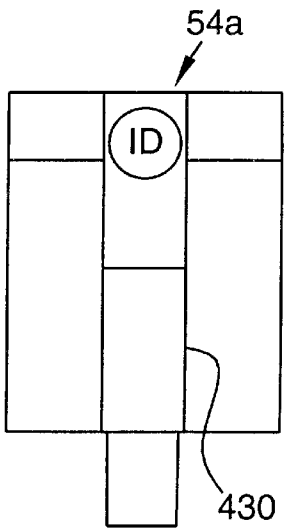
FIG. 22 is another side view of the orifice insert shown in FIG. 21.
Figure 21:
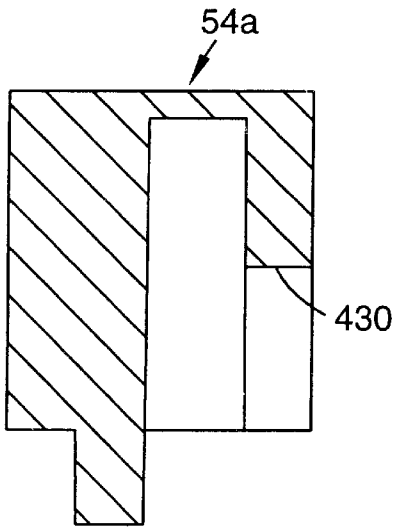
FIG. 21 is a cross-sectional side view of an alternative embodiment of the orifice insert.

FIGS. 17 and 20 also illustrate an optional, but preferred side ear 320 (shown in dashed lines) on a side of side projection 308. Side ear 320 is received in a corresponding notch (not shown) in second tube 116 of first valve part 40 adjacent to aperture 140 of first valve part 40. The side ear 320 and corresponding notch only allows orifice insert 54 to fit one way into first valve part 40. Inadvertent, upside down positioning of orifice insert 54 would be prevented by side ear 320 and the corresponding notch.

Figure 23:
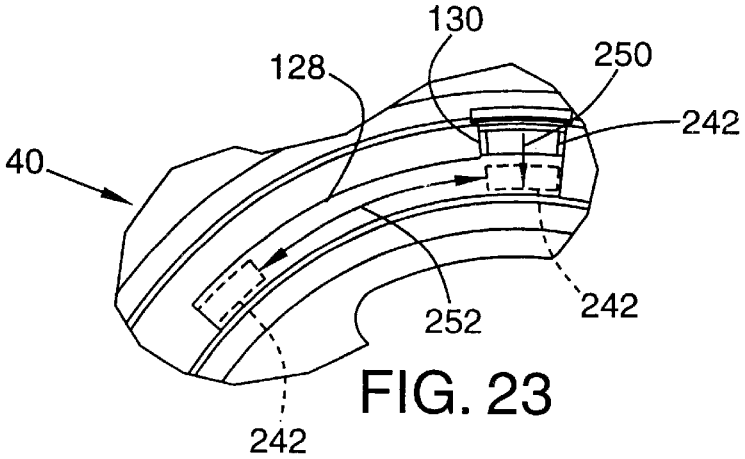
FIG. 23 is an enlarged top view of a portion of the valve cap showing the tamper resistant locking tab and slot.
Figure 12:
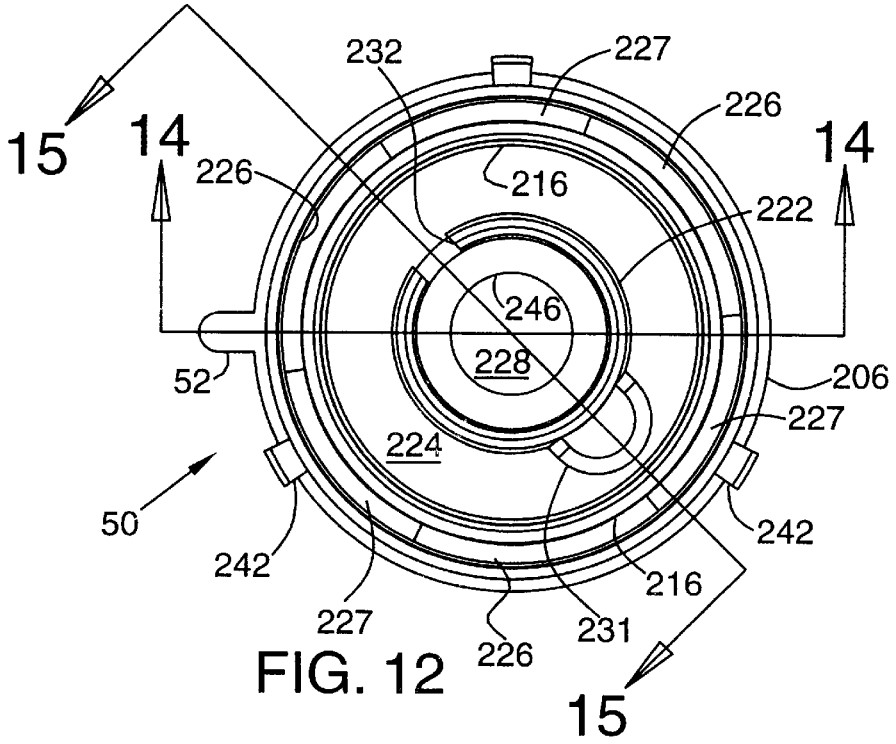
FIG. 12 is a top view of the second valve part.
Figure 13:
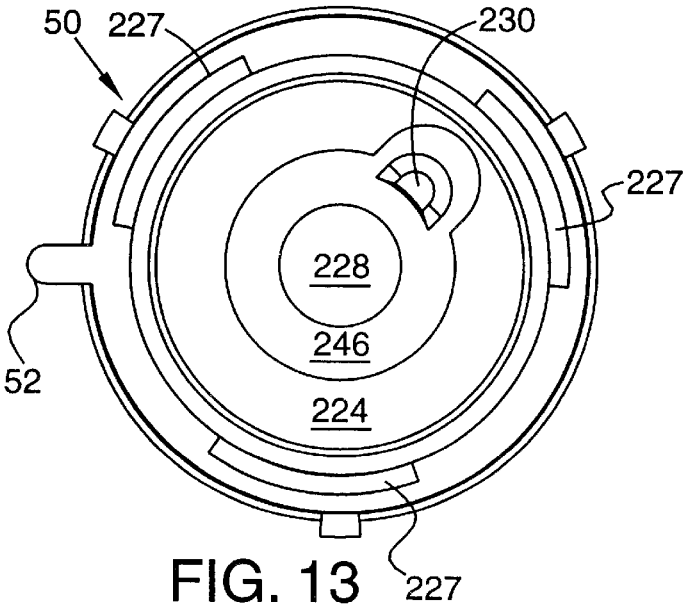
FIG. 13 is a bottom view of the second valve part.
Figure 16:
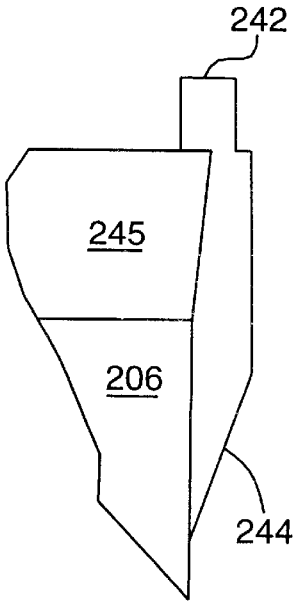
FIG. 16 is an enlarged view of a portion of the second valve part showing a tamper resistant locking tab.
Figure 14:
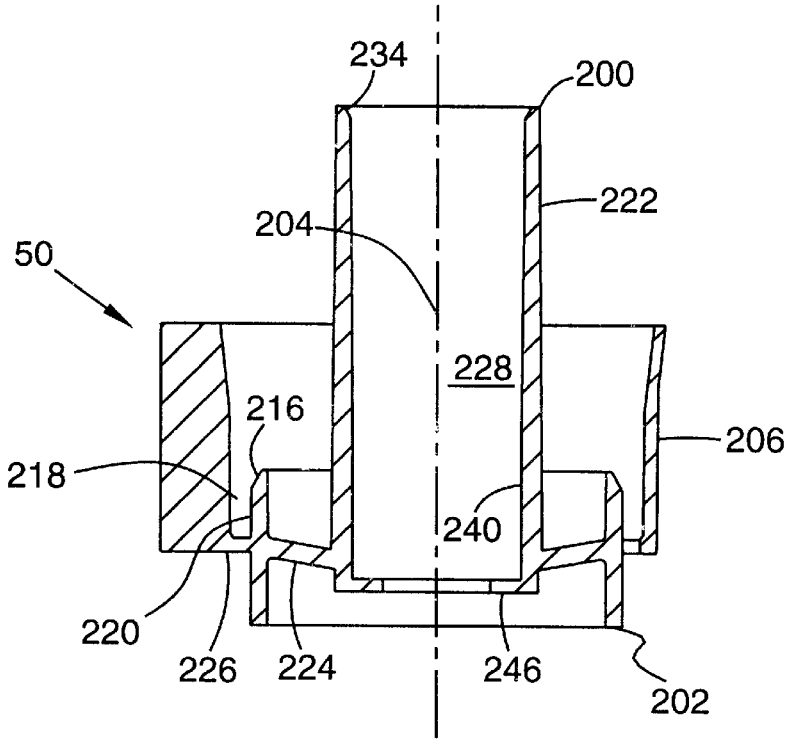
FIG. 14 is a cross-sectional side view of the second valve part taken along lines 14—14 of FIG. 12.
Figure 15:
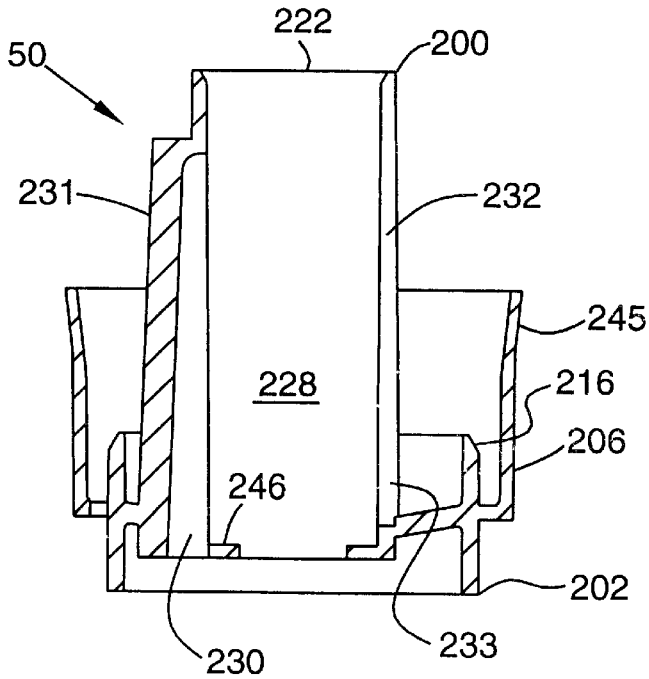
FIG. 15 is a cross-sectional side view of the second valve part taken along lines 15—15 of FIG. 12.
Figure 18:
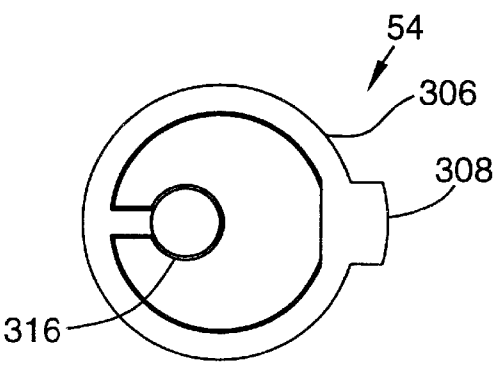
FIG. 18 is a bottom view of the orifice insert.

Referring now to FIG. 23, the tamper resistant features are illustrated in more detail. When valve cap 16 is in the locked condition, each locking tab 242 is positioned in a locking notch 130 of first valve part 40. When bottle 14 is operatively positioned in dispenser assembly 12, each locking tab 242 is moved radially inwardly as shown in FIG. 23 in the direction of arrow 250. With each locking tab 242 in the inner position, locking notch 130 is no longer effective in limiting the ability of first valve part 40 and second valve part 50 to be rotated relative to one another. When locking tab 242 is in the inner position, relative rotation of first valve part 40 with second valve part 50 is possible in the direction of arrow 252 within slot 128. Locking tab 242 is placed in the inner position due to engagement of each ramp 244 with sidewall 19 defining chamber 18 of dispenser assembly 12. To fully open valve cap 16, locking tab 242 is rotated to the end of slot 128 opposite to locking notch 130. By positioning a plurality of locking tabs 242 around second valve part 50, and by positioning them close to camming flange 42, a user trying to bypass using dispenser assembly 12 will have an impossible or difficult time moving by hand all tabs 242 radially inwardly at the same time to allow for second valve part 50 to be rotated relative to first valve part 40. While a plurality of slots 128 and locking tabs 242 are shown, more or less, including one of each can be provided to make valve cap 16 tamper resistant.

With the above-noted tamper resistant system, valve cap 16 can only likely be opened if bottle 14 is operatively engaged with dispenser assembly 12. This would prevent a user from opening the bottle separate from dispenser assembly 12, and squeezing out the contents of bottle 14, possibly over dispensing the concentrate from bottle 14. Over dispensing can be wasteful, and it can also create a more hazardous mixture having too much concentrate present. The tamper resistant features are also effective in preventing inadvertent dispensing such that bottle 14 will remain in the locked and closed state until the user positions bottle 14 in dispenser assembly 12, and rotates the bottle so as to open valve cap 16 to begin dispensing of the concentrate through dispenser assembly 12. Such features are useful during storage and transport.

Figure 27:
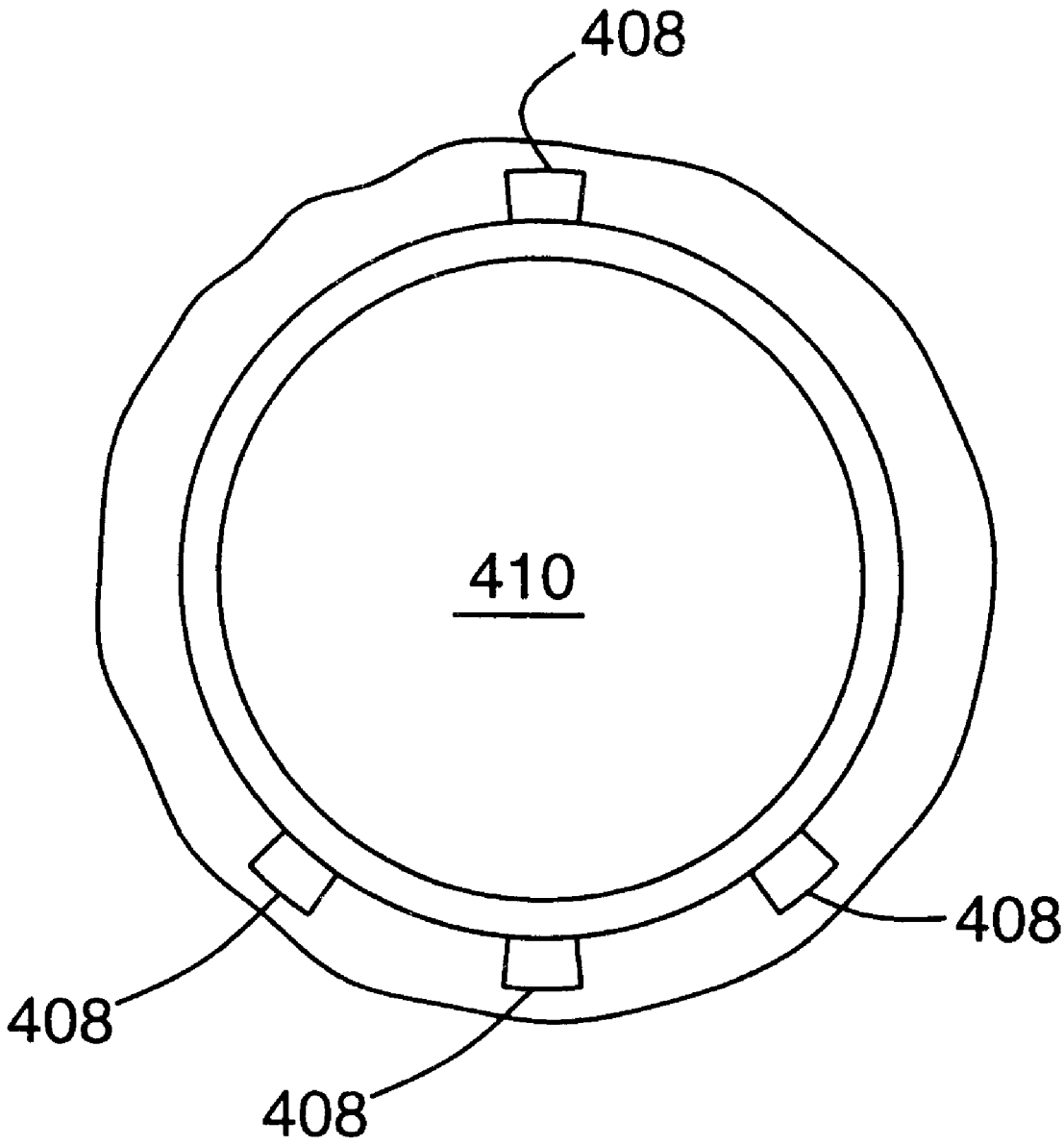
FIG. 27 is a bottom view of a portion of the bottle showing the neck and the orifice.

Referring now to FIGS. 24–28, bottle body 60 is shown including an upper closed end 400, a lower open end 402, and a longitudinal central axis 404. Adjacent to lower open end 402 is bottle neck 406, and orifice 410. Bottle body 60 snaps to valve cap 16 during assembly in the preferred embodiment. A plurality of projections 408 permit snap mounting of bottle body 60 to valve cap 16. Each projection 408 includes a ramp surface 412, and a raised platform 414 for engaging an inside surface of bottle collar 106 of first valve part 40. With particular reference to FIG. 27, neck 406 is shown as including unequally spaced projections 408, so as to permit only one way mounting of valve cap 16 on bottle body 60. First valve part 40 includes unequally spaced apertures 112 for receipt of the unequally spaced projections 408. This results in camming flange 42 of valve cap 16 being in the proper position, and a predetermined portion of bottle body 60 facing the user during operation. Generally, body 60 includes a round central region 416 having a generally cylindrical outer surface 417. Outer surface 417 is suitable for receipt of a product label. Adjacent to upper closed end 400 are opposed gripping panels 418 for gripping by the hand as shown in FIG. 2. An inside surface 420 of orifice 410 seals against bottle sealing surface 144 of first valve part 40 to form bottle and valve cap fluid tight seal 62. Bottle body 60 is preferably made from molded plastic, such as high density polyethylene or other moldable plastic.

The construction of bottle 14, with valve cap 16, allows bottle 14 to be used with prior art dispenser assemblies 12 like those disclosed in U.S. Pat. No. 5,425,404 and shown in FIGS. 1 and 3, or other dispenser assemblies configured to engage valve cap 16 during use.

While first valve part 40 is shown with inner tube 116 inside inner tube 222 of second valve part 50, inner tube 116 could also be outside of inner tube 222 of second valve part 50. Also, while inner tube 116 includes airflow aperture 138 and fluid flow aperture 140 through the tubular portion, and second valve part 50 forms the air inlet and the fluid outlet by the presence of side projection 231 and slot 232, second valve part 50 could also be tubular in shape with an air flow aperture and a fluid flow aperture opened and closed by a first valve part configured to allow air to enter bottle 14 and fluid to exit. Also, orifice insert 54 is optional, as desired. Fluid flow rate control could be provided by directly sizing one of the fluid outlets of the first and second valve parts 40, 50 for flow control. Further, orifice insert 54, when provided, could be located elsewhere besides the position shown, as long as orifice insert 54 is in the fluid outlet flow path to enable fluid flow rate control.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A dispensing valve cap for use with a bottle having an outlet and containing fluid for dispensing the fluid in a gravity feed fluid dispensing system, the valve cap comprising:

a first valve part having a first end and a second end, the first end adapted to be fixedly mounted to the outlet of the bottle, the first valve part including a tubular sidewall portion defining a longitudinal axis extending in a direction from the first end to the second end, the tubular sidewall portion including an air inlet aperture through the tubular sidewall portion, the tubular portion further including a fluid outlet aperture through the tubular sidewall portion, the air inlet aperture spaced apart from the fluid outlet aperture along the longitudinal axis, the air inlet aperture adjacent to the first end, the fluid outlet aperture adjacent to the second end; and a second valve part rotatably mounted to the first valve part about the longitudinal axis, the second valve part including a mating portion adapted to cooperate with the tubular sidewall portion of the first valve part to close the air inlet and the fluid outlet apertures of the first valve part when the second valve part is in a first position relative to the first valve part, and to open the air inlet and the fluid outlet apertures of the first valve part when the second valve part is in a second position relative to the first valve part, the second valve part defining a fluid passageway for fluid to exit the valve cap at an exit opening location at a bottom of the valve cap, the fluid passageway extending in a direction parallel to the longitudinal axis of the first valve part at the exit opening which is disposed such that the fluid exits the fluid passageway in a direction parallel to the longitudinal axis.

2. A gravity feed fluid dispensing system comprising:

a bottle having an outlet;

a valve cap including:

a first valve part having a first end and a second end, the first end fixedly mounted to the outlet of the bottle, the first valve part including a tubular portion defining a longitudinal axis extending in a direction from the first end to the second end, the tubular portion including an air inlet aperture through the tubular portion, the tubular portion farther including a fluid outlet aperture through the tubular portion, the air inlet aperture spaced apart from the fluid outlet aperture along the longitudinal axis, the air inlet aperture adjacent to the first end, the fluid outlet aperture adjacent to the second end;

a second valve part rotatably mounted to the first valve part about the longitudinal axis, the second valve part including a mating portion adapted to cooperate with the tubular portion of the first valve part to close the air inlet and the fluid outlet apertures of the first valve part when the second valve part is in a first position relative to the first valve part, and to open the air inlet and the fluid outlet apertures of the first valve part when the second valve part is in a second position relative to the first valve part;

at least one locking tab extending from the second valve part, and at least one arcuate slot including a locking notch at one end of the arcuate slot positioned on the first valve part, wherein the locking tab is positionable in the locking notch to lock the second valve part and the first valve part from relative rotation, and wherein the locking tab is positionable in the arcuate slot to permit relative rotation between the second valve part and the first valve part; and a dispenser assembly including:

a main body having a sidewall portion defining a valve cap chamber receiving at least a portion of the valve cap, the body including a hold down arrangement for holding the second valve part from movement relative to the main body;

a dilutant inlet to the main body;

a dilutant valve controlling flow of dilutant from the dilutant inlet into the main body;

a mixing chamber in fluid communication with the dilutant valve and the valve cap chamber; and a fluid outlet in fluid communication with the mixing chamber.

3. The dispensing valve cap of claim 2, wherein the hold down arrangement includes the valve cap chamber defining a notch, and further comprising a side projection extending radially outward from the second valve part received in the notch of the dispenser assembly, the sidewall portion of the main body of the dispenser assembly operative in moving the locking tab from the locking notch to the arcuate slot of the first valve part upon insertion of the valve cap in the valve cap chamber.

4. A gravity feed fluid dispensing bottle comprising:

a bottle body including an outlet with a neck with a plurality of outward projections;

a valve cap including:

a first valve part having a first end and a second end, the first end fixedly mounted to the outlet of the bottle, the first valve part including a tubular sidewall portion defining a longitudinal axis extending in a direction from the first end to the second end, the tubular sidewall portion including an air inlet aperture through the tubular sidewall portion, the tubular portion further including a fluid outlet aperture through the tubular sidewall portion, the air inlet aperture spaced apart from the fluid outlet aperture along the longitudinal axis, the air inlet aperture adjacent to the first end, the fluid outlet aperture adjacent to the second end, wherein the first valve part includes a bottle collar mounted to and surrounding the neck of the bottle, the bottle collar including a plurality of apertures, each aperture receiving a projection of the bottle, the first valve part further including a camming flange operative in engaging a dilutant valve of a dispenser assembly; and a second valve part rotatably mounted to the first valve part about the longitudinal axis, the second valve part including a mating portion adapted to cooperate with the tubular sidewall portion of the first valve part to close the air inlet and the fluid outlet apertures of the first valve part when the second valve part is in a first position relative to the first valve part, and to open the air inlet and the fluid outlet apertures of the first valve part when the second valve part is in a second position relative to the first valve part.

5. A gravity feed fluid dispensing system comprising:

a bottle having an outlet;

a valve cap including:

a first valve part fixedly mounted to the outlet of the bottle, the first valve part including a surface portion defining at least one arcuate slot, and a locking notch at one end of the slot, the first valve part further including an air inlet and a fluid outlet; and a second valve part rotatably mounted to the first valve part, the second valve part including a mating portion adapted to cooperate with the first valve part to open and close the air inlet and the fluid outlet, the second valve part further including a locking tab positionable in the arcuate slot when fluid dispensing is desired, the tab further positionable in the notch so as to lock the second valve part from movement relative to the first valve part, wherein the air inlet and the fluid outlet of the first valve part are open when the locking tab is positioned at an end of the arcuate slot opposite the notch, and wherein the air inlet and the fluid outlet of the first valve part are closed when the locking tab is positioned in the notch; and a dispenser assembly including:

a main body having a sidewall portion defining a valve cap chamber receiving at least a portion of the valve cap, the main body including a hold down arrangement for holding the second valve part from movement relative to the main body;

a dilutant inlet to the main body;

a dilutant valve controlling flow of dilutant from the dilutant inlet into the main body;

a mixing chamber in fluid communication with the dilutant valve and the valve cap chamber; and a fluid outlet in fluid communication with the mixing chamber.

6. The dispensing valve cap of claim 5, wherein the hold down arrangement includes the valve cap chamber defining a notch, and further comprising a side projection extending radially outward from the second valve part received in the notch of the dispenser assembly, the sidewall portion of the main body of the dispenser assembly operative in moving the locking tab from the locking notch to the arcuate slot of the first valve part upon insertion of the valve cap in the valve cap chamber.

7. A dispensing valve cap for use with a bottle having an outlet and containing fluid for dispensing the fluid in a gravity feed fluid dispensing system, the valve cap comprising:

a first valve part adapted to be fixedly mounted to the outlet of the bottle, the first valve part including a fluid outlet and an air inlet;

a second valve part rotatably mounted to the first valve part, the second valve part including a mating portion adapted to cooperate with the first valve part to close the air inlet and the fluid outlet of the first valve part, the second valve part further including a fluid outlet and an air inlet, wherein the air inlet and the fluid outlet of the second valve part are aligned with the air inlet and the fluid outlet of the first valve part, respectively, when the second valve part and the first valve part are in a first position relative to each other, and wherein the air inlet and the fluid outlet of the first valve part are closed when the second valve part and the first valve part are in a second position relative to each other;

a snap arrangement between the second valve part and the first valve part for locking the second valve part and first valve part from longitudinal movement; and an orifice insert member including a fluid control aperture having a predetermined size for the fluid to be dispensed from the bottle, the fluid control aperture positioned to communicate with the fluid outlets of the second valve part and the first valve part during fluid dispensing, the orifice insert member trapped between the snapped together second valve part and first valve part;

wherein the first valve part includes a tubular portion and an aperture through the tubular portion, wherein the orifice insert member has a generally cylindrically-shaped outer surface portion received within the tubular portion of the first valve part, the orifice insert member further including an outwardly extending side projection received within the aperture of the first valve part, the side projection including the fluid control aperture, and wherein the orifice insert member defines an inner chamber in fluid communication with the fluid control aperture, the orifice insert member including a projecting post.

8. A method of dispensing fluid comprising the steps of:

providing a bottle containing fluid therein, the bottle having a valve in fluid communication with an interior of the bottle, the valve including a lock having a locking tab movable between a locked position wherein the valve cannot be opened and an unlocked position wherein the valve can be opened;

mounting the bottle to a dispenser assembly;

engaging a portion of the valve with the dispenser assembly to unlock the lock of the valve during mounting of the bottle to the dispenser assembly, wherein the dispenser assembly moves the locking tab of the lock to the unlocked position to unlock the valve;

rotating a first portion of the unlocked valve relative to a second portion of the valve;

dispensing the fluid from the bottle under gravity through the unlocked and rotated valve, and allowing air to enter the bottle from the atmosphere; and mixing the fluid dispensed from the bottle with dilutant supplied by the dispenser assembly.

* * * * *

UNITED STATES PATENT AND TRADEMARK OFFICE

CERTIFICATE OF CORRECTION

PATENT NO. : 6,488,058 B1
DATED : December 3, 2002
INVENTOR(S) : Dyer, John J.

It is certified that error appears in the above-identified patent and that said Letters Patent is hereby corrected as shown below:

Column 4,
Line 3, “bottle 60” should read -- bottle body 60 --;

Column 10,
Line 39, “location” should read -- located --;
Line 54, “farther” should read -- further --; and Column 14,
Line 6, “opened and” should read -- opened, and --.

Signed and Sealed this

Tenth Day of August, 2004

JON W. DUDAS
*Acting Director of the United States Patent and Trademark Office*